US011541682B1

(12) United States Patent
Chang

(10) Patent No.: US 11,541,682 B1
(45) Date of Patent: Jan. 3, 2023

(54) MULTI-RING BINDER

(71) Applicant: Jyh-Yuan Chang, Taoyuan (TW)

(72) Inventor: Jyh-Yuan Chang, Taoyuan (TW)

( * ) Notice: Subject to any disclaimer, the term of this patent is extended or adjusted under 35 U.S.C. 154(b) by 0 days.

(21) Appl. No.: 17/693,351

(22) Filed: Mar. 12, 2022

(30) Foreign Application Priority Data

Feb. 11, 2022 (TW) ..... 111105106

(51) Int. Cl.
*B42F 13/26* (2006.01)
*B42F 13/22* (2006.01)

(52) U.S. Cl.
CPC ..... *B42F 13/26* (2013.01); *B42F 13/22* (2013.01)

(58) Field of Classification Search
CPC ..... B42F 13/22; B42F 13/26
USPC ..... 402/42
See application file for complete search history.

(56) References Cited

U.S. PATENT DOCUMENTS 734,474 A * 7/1903 Sheridan ..... B42F 13/26 402/45
743,114 A * 11/1903 Trussel ..... B42F 13/26 402/42
2012/0288322 A1* 11/2012 Tanaka ..... B42F 13/26 402/30

FOREIGN PATENT DOCUMENTS

| | | | | |
|---|---|---|---|---|
| CH | 190738 A | * | 5/1937 | |
| FR | 973113 A | * | 2/1951 | |
| JP | 5792405 B1 | * | 10/2015 | ..... B42F 13/18 |
| JP | 6516275 B1 | * | 5/2019 | ..... B42F 13/22 |
| WO | WO-2013191216 A1 | * | 12/2013 | ..... B42F 13/16 |

* cited by examiner

*Primary Examiner* — Kyle R Grabowski

(57) ABSTRACT

A multi-ring binder includes a positioning lock pin, a movable central spindle, a first bracket, a second bracket and a C-ring. The movable central spindle is formed by a plurality of cylindrical bodies and a plurality of rectangular bodies staggered, and the top of the movable central spindle is connected to the positioning lock pin and the surface of the rectangular body next to the top has a first positioning groove and a second positioning groove. The first bracket has first half-rings arranged equidistant from each other, and first hollow bodies arranged equidistant from each other. The second bracket is complementary and symmetrical with the first bracket, and has second half-rings arranged equidistant from each other, and second hollow bodies arranged on equidistant from each other.

15 Claims, 14 Drawing Sheets

MULTI-RING BINDER

BACKGROUND OF THE INVENTION

1. Field of the Invention

The present invention relates to ring binder technology, especially a multi-ring binder used in loose-leaf notebooks.

2. Description of the Related Art

The loose-leaf binder can be used to fix the paper, and its structure mainly includes the front cover, the back cover and the hole clip between the front cover and the back cover. The hole clip includes a plurality of coils or half-rings for the paper with holes to pass through each coil or ring and be fixed in the binder. Common hole clips are divided into closed coils and switchable half-rings. The former closed coil (such as spiral ring binder) has the characteristics of flexible operation and can be folded in half at 360 degrees, which is easy to operate with one hand and requires less space. However, because the coil is in a closed state after the finished product is completed, it cannot be opened, so it is impossible to add or replace paper arbitrarily. The latter is a switchable half-ring (such as loose-leaf ring binder). Because the half-ring is designed to be opened and closed, so the user can arbitrarily change its inner pages. However, due to the large size of the switch structure, it lacks the flexible operation of the closed coil, and cannot be folded backwards. It is difficult to hold with one hand during use, and usually requires a large operating space. In addition, when opening and closing this type of design, it is usually necessary to use both hands to press the switches located at both ends to open, which is difficult to operate. When closing, it is necessary to press several coils at the same time to offset the internal spring tension, and then automatically bounce back to the closed state by the spring tension, which often leads to noise generation and the possibility of pinching. In addition, the half-ring design of most ring binders often creates gaps at the joint due to the problem of aging of the process or long-term use of materials, resulting in the phenomenon of paper jamming, resulting in difficulty in turning pages or damage to the holes in the inner pages.

SUMMARY OF THE INVENTION

The present invention has been accomplished under the circumstances in view. It is therefore the main object of the present invention to provide a multi-ring binder used in a loose-leaf notebook with multiple loose-leaf pages. The multi-ring binder comprises a positioning lock pin, a movable central spindle, a first bracket, a second bracket and a C-ring. The movable central spindle comprises a main body formed by alternatively connecting a plurality of cylindrical bodies and a plurality of rectangular bodies in a line, and a body top located on a top side of the main body and connected to the positioning lock pin. The rectangular body adjacent to the body top comprises a first positioning groove and a second positioning groove. The movable central spindle is drivable to move by the positioning lock pin. The first bracket comprises a plurality of first half-rings and a plurality of second half-rings staggered and arranged thereon at equal distances from each other, and a plurality of first hollow bodies and a top hollow body arranged thereon at appropriate intervals. The shapes of the first hollow bodies and the top hollow body are both outer circle and inner square. The second bracket and the first bracket being substantially complementary symmetrical. The second bracket comprises a plurality of first half-rings and a plurality of second half-rings staggered and arranged thereon equidistantly from each other, and a plurality of second hollow bodies and a bottom hollow body arranged thereon at appropriate intervals. The shapes of the second hollow bodies and the bottom hollow body are both outer circle and inner square. The shapes and positions of the second half-rings correspond to the first half-rings. The C-ring is connected to the first bracket. Through the symmetrical engagement of the first bracket and the second bracket, the first hollow bodies and the second hollow bodies are joined to each other to form a continuous hollow body. The movable central spindle is arranged in the continuous hollow body to serve as the common central axis of rotation of the first bracket and the second bracket. The external shape of the continuous hollow body is an outer circle and an inner square.

Preferably, the length of the rectangular bodies is less than the length of the first hollow bodies or less than the length of the second hollow bodies.

Preferably, the external shape of the top hollow body of the first bracket is an outer circle and an inner square, and the top hollow body of the first bracket comprises a C-ring groove that accommodates the C-ring.

Preferably, the C-ring performs a positioning action by engaging in the first positioning groove or the second positioning groove.

Preferably, after the positioning lock pin is pulled up and drives the movable central spindle, the C-ring is engaged with the second positioning groove.

Preferably, when the C-ring is engaged with the second positioning groove, the rectangular bodies on the movable central spindle move to the inside of the first hollow bodies or the second hollow bodies respectively to enter the unlocked state, thereby allowing the first half-rings or the second half-rings rotary movement to open or close the rings.

Preferably, after the positioning lock pin is pushed back and drives the movable central spindle, the C-ring is engaged with the first positioning groove.

Preferably, when the C-ring is engaged with the first positioning groove, a part of the rectangular bodies on the movable central spindle is moved to the inside of the first hollow bodies and the other part of the rectangular bodies is moved to the inside of the second hollow bodies to enter a locked state, in turn, the first half-rings and the second half-rings are prohibited from rotation to open or close the rings.

Preferably, when the positioning lock pin is pulled up and drives the movable central spindle into the unlocked state, the user manually rotates the first bracket or the second bracket around the movable central spindle to open or close the rings.

Preferably, the movable central spindle has one end thereof provided with a limit portion and an opposite end thereof connected to the positioning lock pin, and the opening and closing states of the movable central spindle are controlled through the positioning lock pin.

Preferably, the first half-rings are semi-circular, each having a convex top and a concave bottom.

Preferably, the second half-rings are semi-circular, each having a convex bottom and a concave top.

Preferably, when the movable central spindle is in the closed state, the first half-rings on the first bracket and the second half-rings on the second bracket are respectively snapped with each other to form a respective ring, and the second half-rings on the first bracket and the first half-rings on the second bracket are respectively snapped with each other to form a respective ring.

Preferably, the positional layout of the half-rings of the first bracket is a staggered pattern of the first half-ring, the second half-ring and the first half-ring in sequence.

Preferably, the positional layout of the half-rings of the second bracket is a staggered pattern of the second half-ring, the first half-ring and the second half-ring in sequence.

To sum up, the multi-ring binder for a loose-leaf notebook with a plurality of loose-leaf pages disclosed in the present invention can bring the following effects:

1. High security and high stability.
2. Make it easy for users to operate the switch and replace the inner page.
3. The page turning is smooth, and it can effectively avoid the tearing and damage of the paper holes, which can prolong the service life of the notebook.
4. The notebook is easy to fold back, easy to hold with one hand, and highly flexible.
5. The structure is relatively simple, which can reduce the process and cost, and reduce the failure rate.

The following describes in detail by specific embodiments, to make it easier to understand the purpose, technical content, characteristics and effects of the present invention.

DETAILED DESCRIPTION OF THE PREFERRED EMBODIMENTS

In order to solve many problems of the current loose-leaf ring binder, the inventor has made many years of research and development to improve the criticism of the existing products. The follow-up will introduce in detail how the present invention uses a multi-ring file hole folder to achieve the most efficient function.

Figure 1:
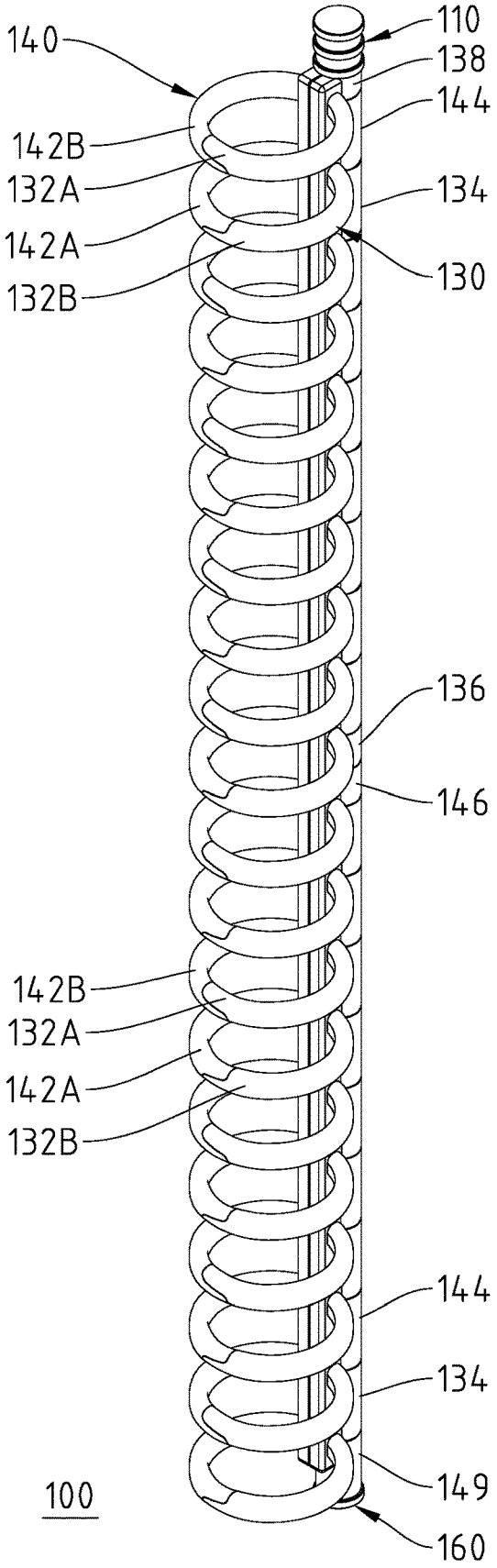
FIG. 1 is a schematic three-dimensional appearance of the multi-ring binder of the present invention.
Figure 2:
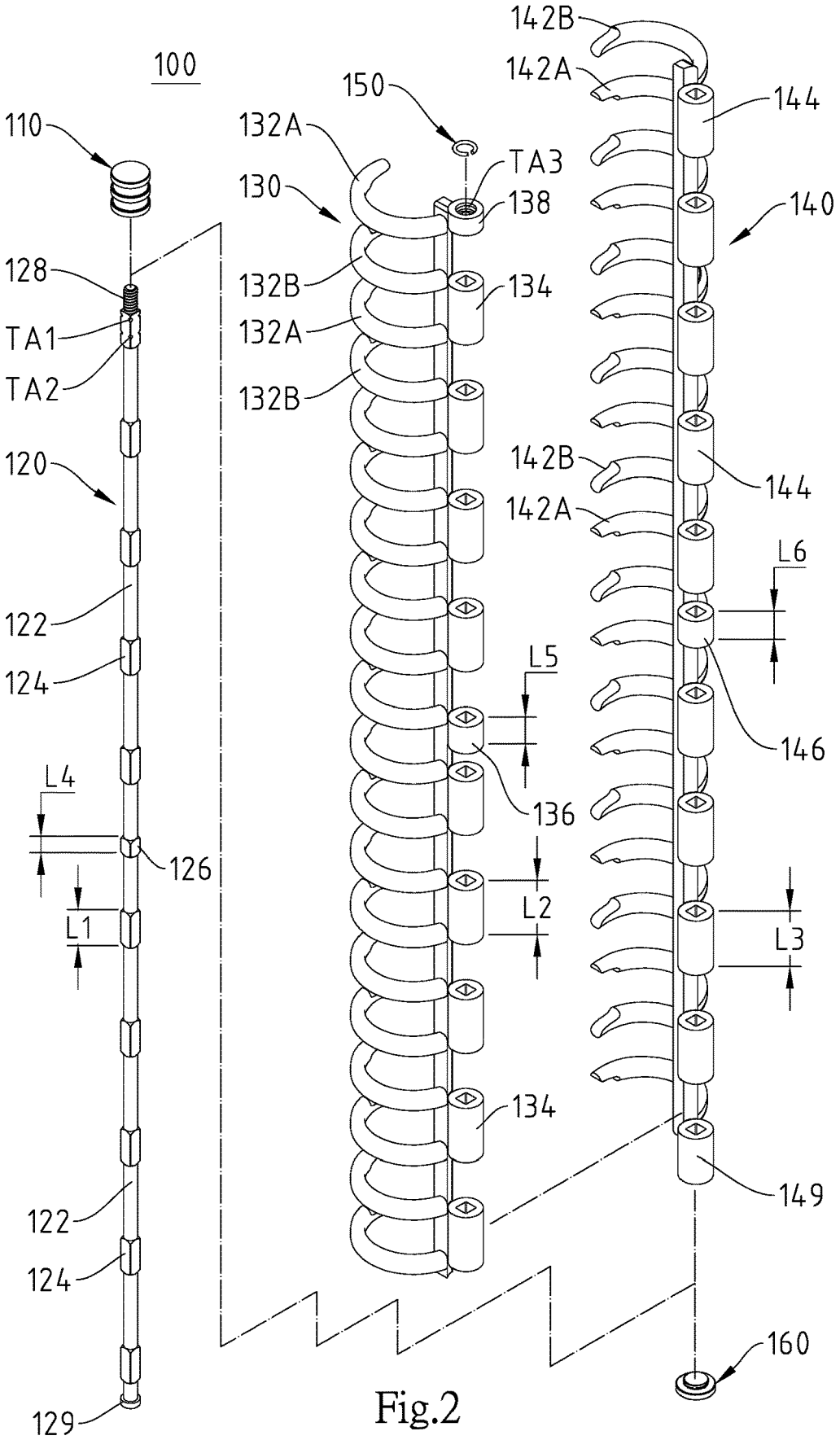
FIG. 2 is a three-dimensional exploded schematic view of the multi-ring binder of the present invention.
Figure 3:
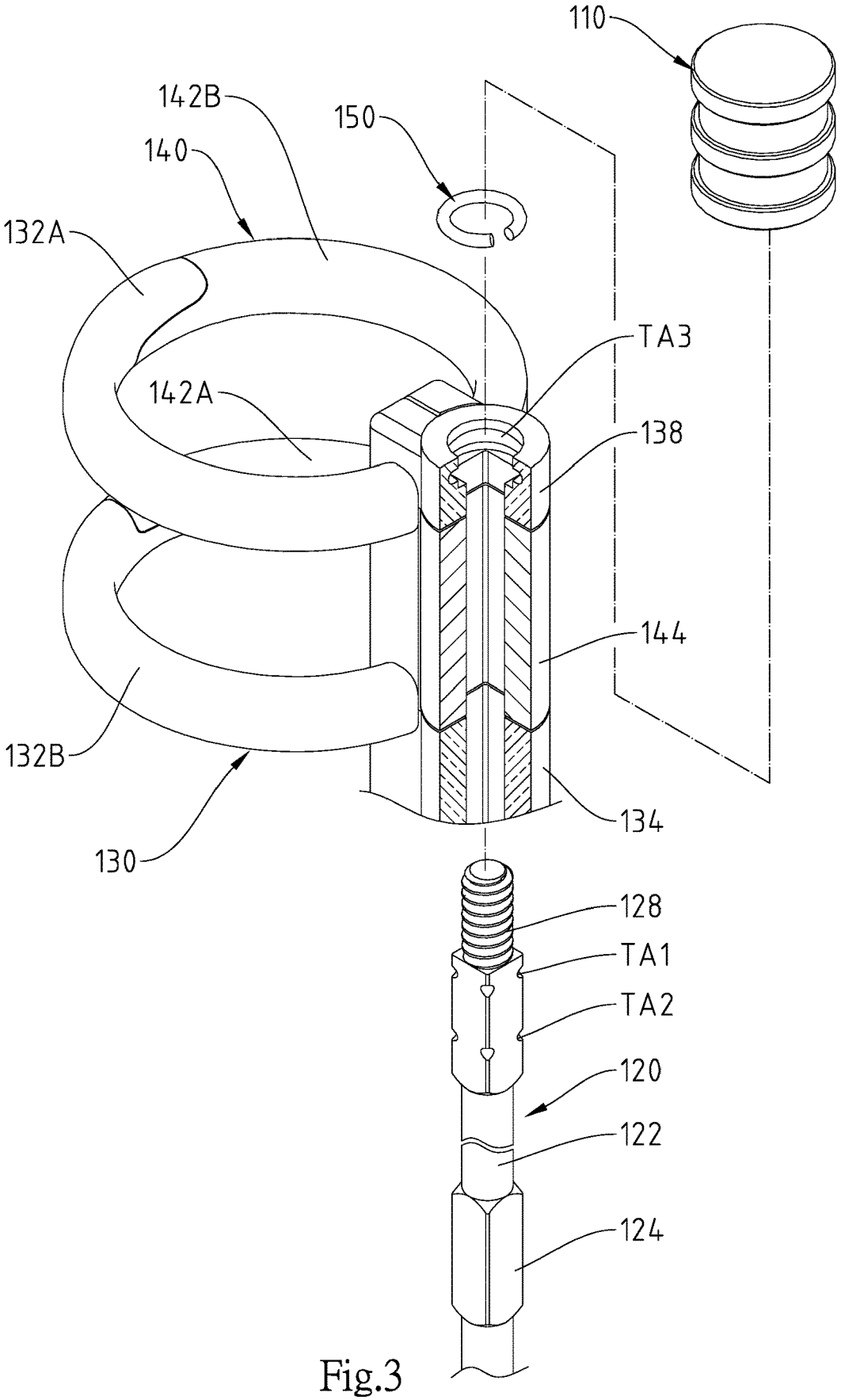
FIG. 3 is a schematic exploded view of a part of the multi-ring binder of the present invention.

Please refer to FIGS. 1-3, where FIG. 1 is a schematic three-dimensional appearance of the multi-ring binder of the present invention, FIG. 2 is a three-dimensional exploded schematic view of the multi-ring binder of the present invention, and FIG. 3 is a schematic exploded view of a part of the multi-ring binder of the present invention. As shown in the drawings, in the embodiment of the present invention, for a loose-leaf notebook with a plurality of loose-leaf pages, the multi-ring binder 100 comprises a positioning lock pin 110, a movable central spindle 120, a first bracket 130, a second bracket 140, a C-ring 150 and a bottom cover 160.

One side of the movable central spindle 120 has a limit portion 129, the function of which will be described later. The main body of the movable central spindle 120 is formed by alternatively connecting a plurality of cylindrical bodies 122 and a plurality of rectangular bodies 124 in a line. In one embodiment, the entire movable central spindle 120 can be made in one piece, but it is not limited to this. The main body of the movable central spindle 120 also has a rectangular body 126 having a shorter length L4 (as shown in FIG. 2, compared to the other rectangular bodies 124). In addition, the body top 128 of the movable central spindle 120 is connected to the positioning lock pin 110. The surface of the rectangular body 124 next to the body top 128 has a first positioning groove TA1 and a second positioning groove TA2, the functions of which will be explained in the C-ring in the following paragraphs. The body top 128 may be a spiral body top in the embodiment of the present invention, but it is not limited by this. It should be understood that, in this embodiment of the present invention, the linear movement of the movable central spindle 120 can be driven by the positioning lock pin 110. Next, it will be further described in detail.

The main body of the first bracket 130 has a plurality of first half-rings 132A and a plurality of second half-rings 132B that are staggered and arranged on the first bracket 130 at equal distances from each other. The first bracket 130 also has a plurality of first hollow bodies 134 and a top hollow body 138 that are arranged on the first bracket 130 at appropriate intervals. The shapes of the first hollow bodies 134 and the top hollow body 138 are both outer circle and inner square, and the rectangular hole completely penetrates the cylindrical body. The first bracket 130 also has a first hollow body 136 with a shorter length L5 (as shown in FIG. 2, compared to the other first hollow bodies 134). In addition, it should be noted that the top hollow body 138 of the first bracket 130 is provided with a C-ring groove TA3 therein. In one embodiment, the C-ring 150 is embedded in the C-ring groove TA3 in the top hollow body 138 and the C-ring 150 performs a positioning action by engaging with the first positioning groove TA1 or the second positioning groove TA2. The above-mentioned C-ring 150, first positioning groove TA1 and second positioning groove TA2 are used for positioning to prevent the movable central spindle 120 from leaving the preset position without human operation, but not limited thereto. In other embodiments, similar components can also be used to achieve the same effect, such as the arrangement of magnets or concave and convex points.

In addition, regarding the second bracket 140, the second bracket 140 and the first bracket 130 are substantially complementary symmetrical. The second bracket 140 also has a plurality of first half-rings 142A and a plurality of second half-rings 142B that are staggered and arranged on the second bracket 140 equidistantly from each other. The second bracket 140 also has a plurality of second hollow bodies 144 and a bottom hollow body 149 that are arranged on the second bracket 140 at appropriate intervals. The shapes of the second hollow bodies 144 and the bottom hollow body 149 are both outer circle and inner square, and the rectangular hole completely penetrates the cylindrical body. The second bracket 140 also has a second hollow body 146 with a shorter length L6 (as shown in FIG. 2, compared to the other second hollow bodies 144). In addition, it should be noted that the bottom hollow body 149 of the second bracket 140 is connected with a circular limit space at the lower part of the rectangular hole, which is used to accommodate and limit the moving stroke of the limit portion 129.

When the multi-ring binder 100 of the present invention is in the closed state, the first half-rings 132A on the first bracket 130 and the second half-rings 142B on the second bracket 140 will form complete rings when engaged, or the second half-rings 132B on the first bracket 130 and the first half-rings 142A on the second bracket 140 will form complete rings when engaged. The engagement mode and the number of complete rings are not used to limit the embodiments of the present invention. It is worth noting that, in the embodiment of the present invention, the first bracket 130 and the second bracket 140 are symmetrically engaged with each other, and the plurality of first hollow bodies 134 and the plurality of second hollow bodies 144 are engaged with each other to form a continuous hollow body, like forming a long tunnel. For example, each second hollow body 144 is placed between two first hollow bodies 134. Afterwards, the movable central spindle 120 is inserted and assembled inside the continuous hollow body as the common center spindle of the first bracket 130 and the second bracket 140. The shape of the continuous hollow body is an outer circle and an inner square, and the overall length of the movable central spindle 120 is greater than the length of the continuous hollow body. Finally, the positioning lock pin 110 is installed on the top of the movable central spindle 120, and the bottom cover 160 is installed on the bottom hollow body 149 to complete the multi-ring binder 100 of the embodiment of the present invention. In addition, the length L1 of the rectangular bodies 124 of the movable central spindle 120 is smaller than the length L2 of the first hollow bodies 134, so that the hollow body can completely accommodate the corresponding rectangular body.

It is worth mentioning that the above-mentioned combination of the appearance and shape of the rectangular bodies 124 and the rectangular first hollow bodies 134 and second hollow bodies 144 is used as the description of this embodiment. But in other embodiments, the original rectangular bodies and the rectangular hollow bodies can be triangles, polygons, stars or other shapes to match each other, for example, triangular bodies and triangular hollow bodies, or star bodies and star-shaped hollow bodies.

Next, the operation mechanism of the multi-ring binder 100 according to the embodiment of the present invention will be further described in detail.

Figure 4:
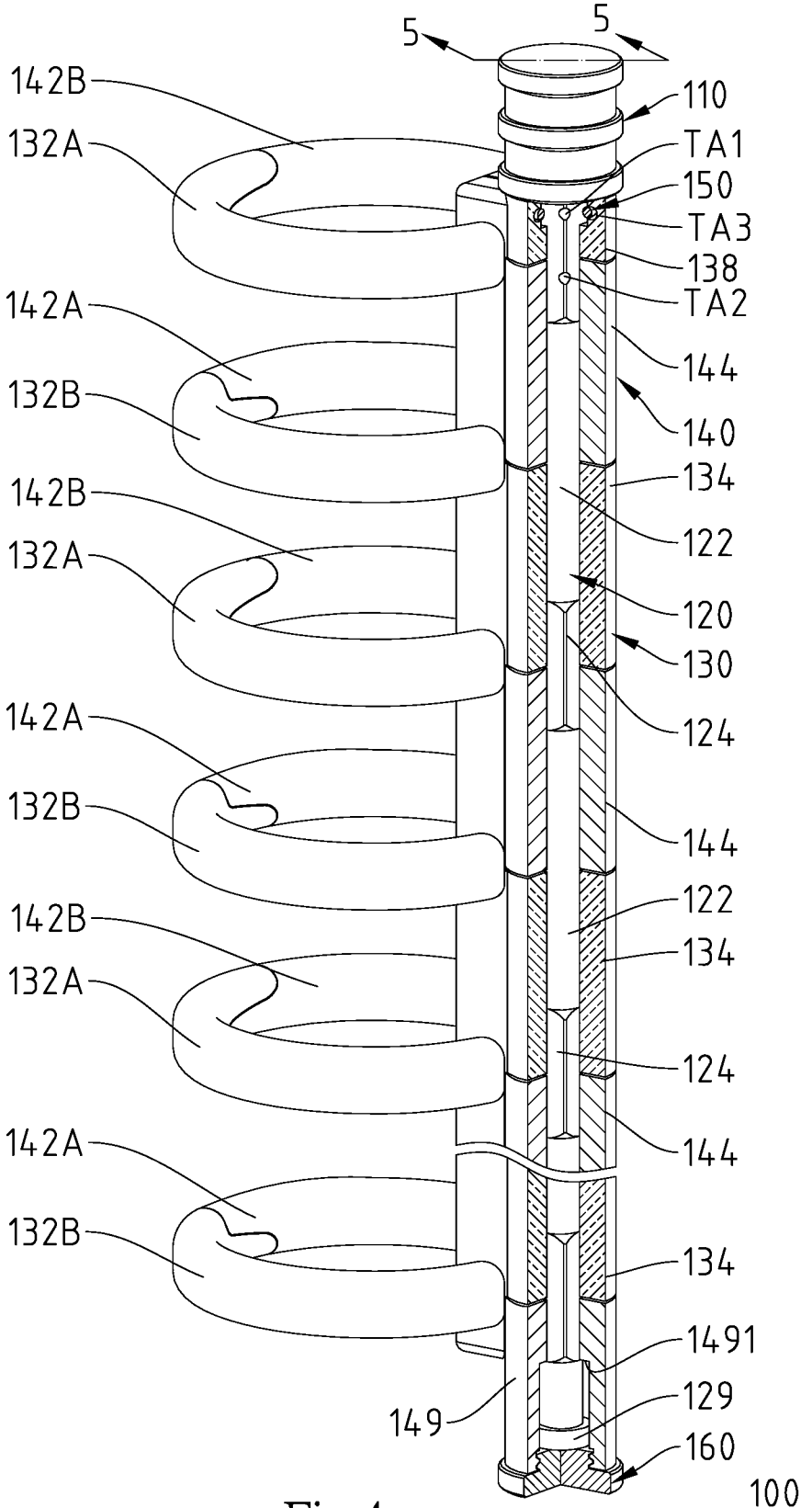
FIG. 4 is a schematic diagram of the locked state of the multi-ring binder of the present invention.
Figure 5:
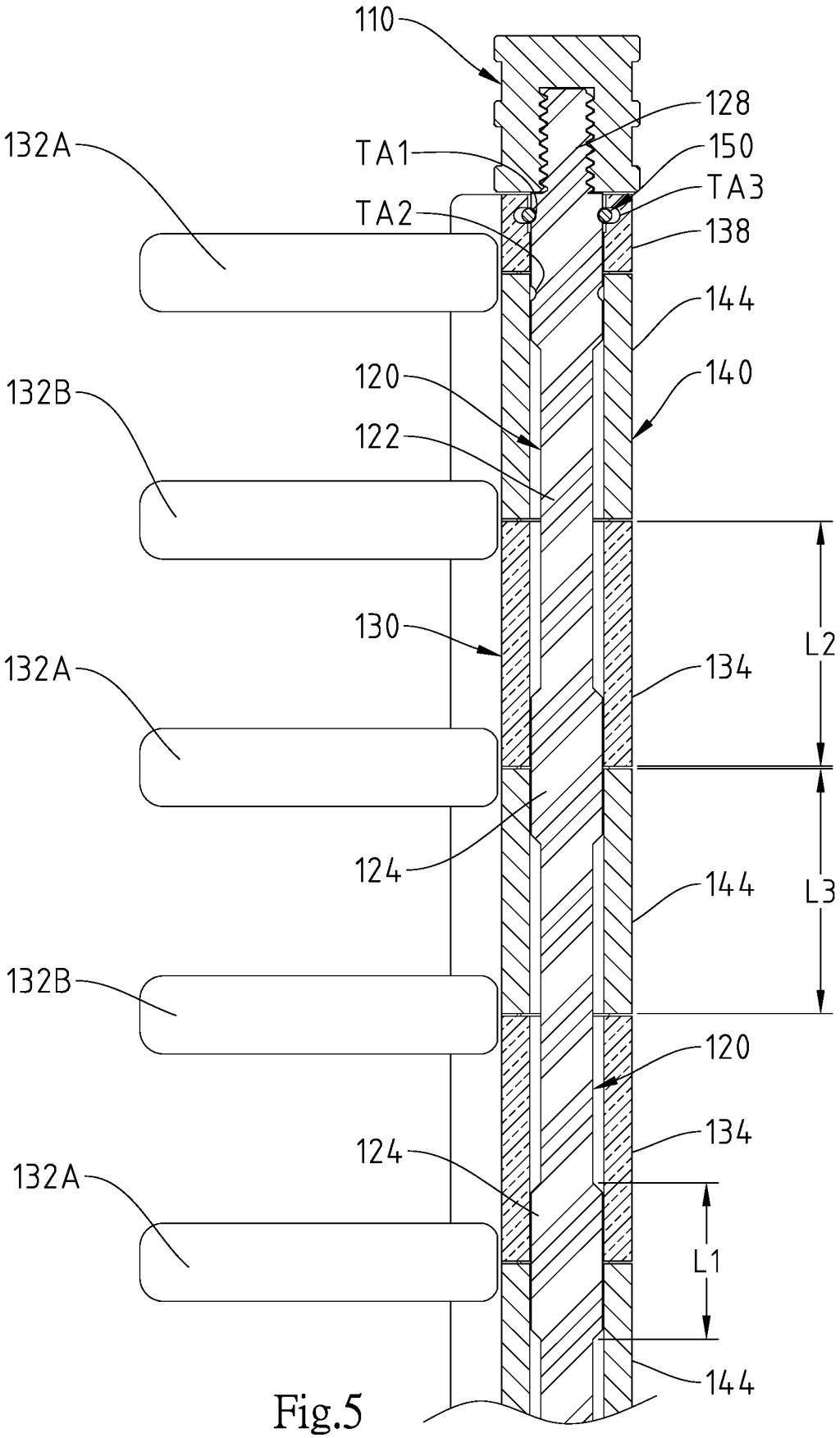
FIG. 5 is a cross-sectional view of FIG. 4 of the present invention.
Figure 6:
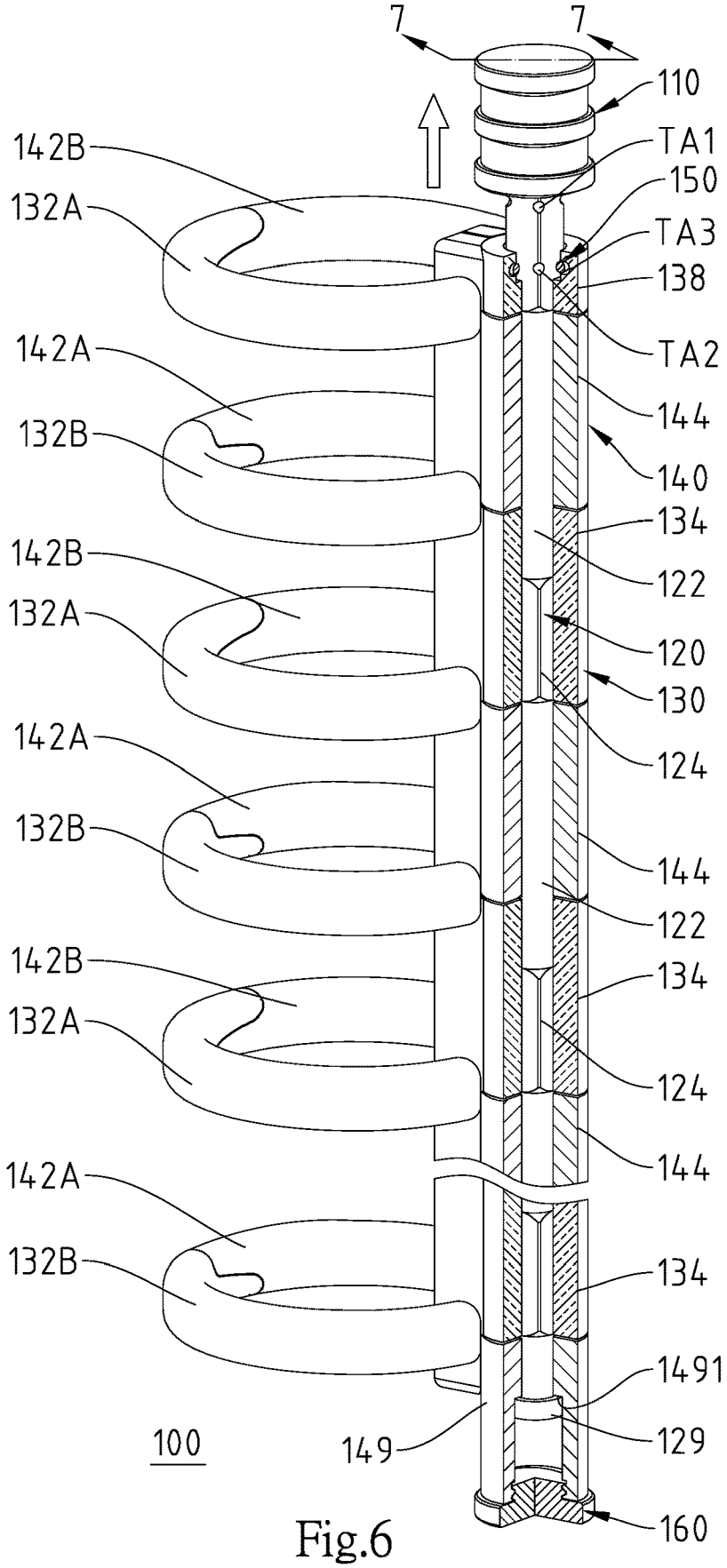
FIG. 6 is a schematic diagram of the unlocked state of the multi-ring binder.
Figure 7:
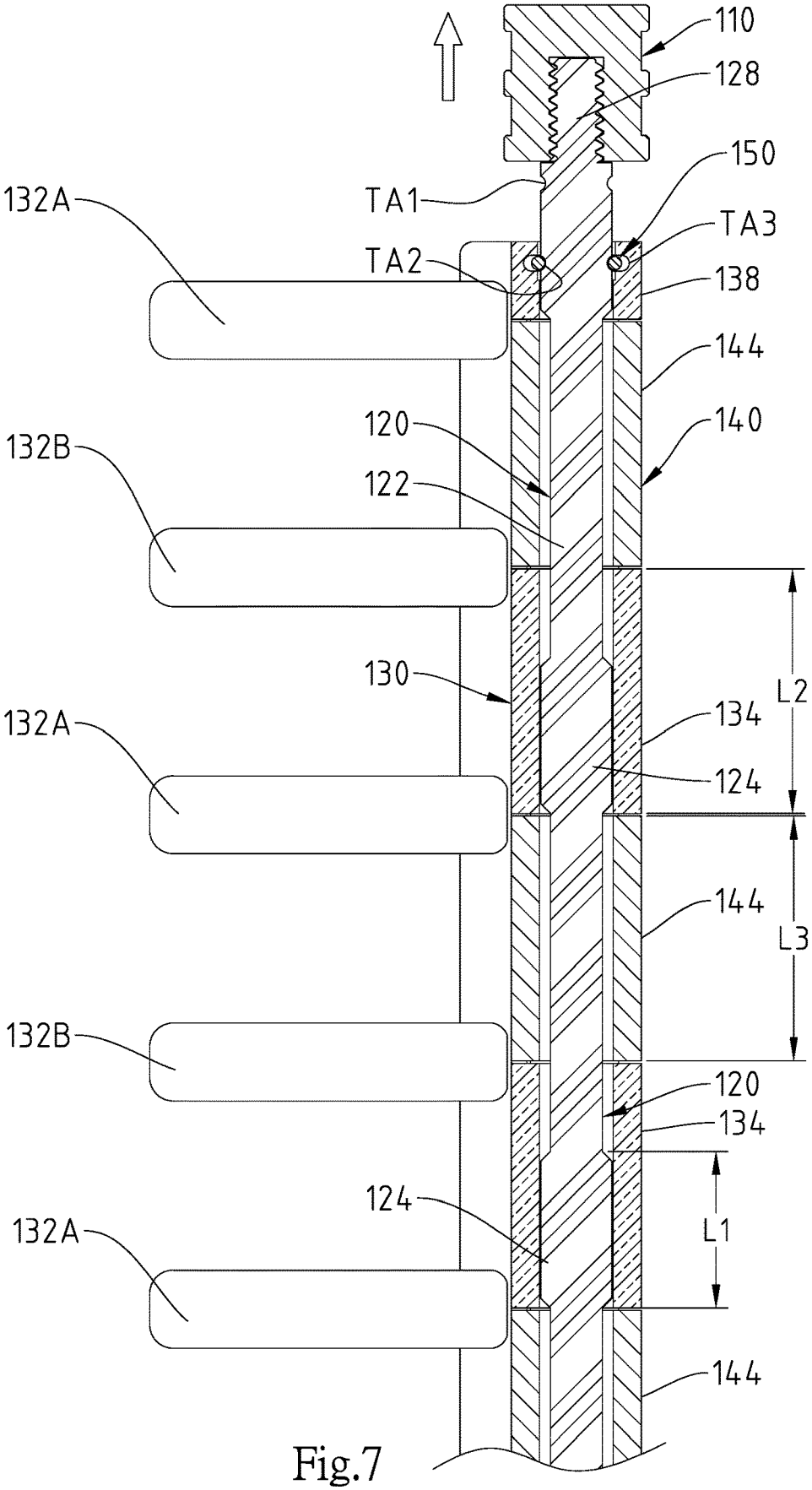
FIG. 7 is a cross-sectional view of FIG. 7 of the present invention.
Figure 8:
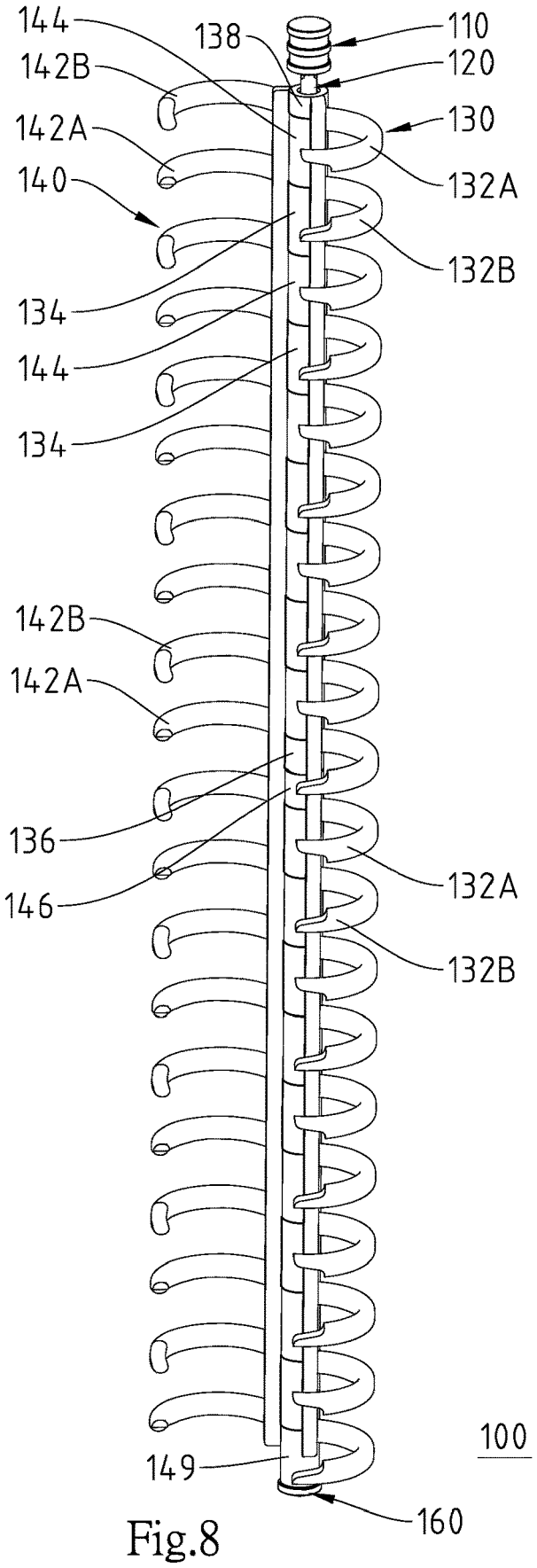
FIG. 8 is a schematic diagram of the open ring state after the multi-ring binder of the present invention is unlocked.

Please refer to FIGS. 4 to 8 at the same time. FIG. 4 is a schematic diagram of the locked state of the multi-ring binder of the present invention. FIG. 5 is a cross-sectional view of FIG. 4 of the present invention. FIG. 6 is a schematic diagram of the unlocked state of the multi-ring binder. FIG. 7 is a cross-sectional view of FIG. 7 of the present invention. FIG. 8 is a schematic diagram of the open ring state after the multi-ring binder of the present invention is unlocked. As shown in FIGS. 4 and 5, when the user pushes the positioning lock pin 110 back, the positioning lock pin 110 will also drive the movable central spindle 120 to move. At this time, the C-ring 150 is engaged to the first positioning groove TA1. Next, a part of the plurality of rectangular bodies 124 on the movable central spindle 120 is moved from the interior of the first hollow bodies 134 to the interior of the second hollow bodies 144, respectively. At this time, the two ends of each of the rectangular bodies are respectively clamped into the rectangular holes of the corresponding first hollow body 134 and the second hollow body 144 to prevent the possibility of relative rotation of the corresponding first hollow body 134 and the second hollow body 144. Thus, the locked state is entered, as shown in FIGS. 4 and 5, and then the plurality of first half-rings 132A (or 142A) and the plurality of second half-rings 132B (or 142B) cannot be rotationally moved to open the rings or close the rings. To put it simply, since the rectangular bodies 124 are located inside the first hollow bodies 134 and the second hollow bodies 144, respectively, the multi-ring binder 100 is locked in a closed state to ensure that the cover and inner pages of the notebook will not be scattered. At this time, the user cannot open the rings to add or replace loose-leaf pages. Its locking method only needs to use the positioning lock pin to make a push action, the user's operation is simple and has high stability. Therefore, when the user reads loose-leaf notes or takes loose-leaf notes, it can bring convenience to use. In addition, because the backbone of the movable central spindle 120 is thinner than the previous technology, it allows the user to fold the notebook back nearly 360 degrees, which is easy to hold with one hand and significantly improves the flexibility of use.

Finally, as shown in FIGS. 6 to 8, when the user pulls up the positioning lock pin 110, the positioning lock pin 110 will also drive the movable central spindle 120 to move upwards. At this time, it should be noted that, because there is a limit portion 129 on the bottom side of the movable central spindle 120, the abutting portion will be contacted when the movable central spindle 120 is pulled up, which can further prevent the movable central spindle 120 from being completely pulled out (please refer to the FIG. 2 and FIG. 6). At this time, the C-ring 150 will be engaged with the second positioning groove TA2, and at the same time, the plurality of rectangular bodies 124 on the movable central spindle 120 will be completely separated from the second hollow bodies 144, and completely moved to the plurality of first hollow bodies 134 internally to let the multi-ring binder 100 enter the unlocked state, and then let the multiple first half-rings 132A (or 142A) and multiple second half-rings 132B (or 142B) rotationally move to open or close the rings. In other words, when the positioning lock pin 110 is pulled up by the user and drives the movable central spindle 120 into the unlocked state, the user can manually rotate the first bracket 130 and the second bracket 140 relatively around the movable central spindle 120 to open or close the rings (the first bracket 130 at this time cannot rotate relative to the movable central spindle). Next, the user can open the rings normally to add or replace loose-leaf pages. Its unlocking operation is simple and has high stability. Here, it should be noted that the materials of the positioning lock pin 110, the movable central spindle 120, the first bracket 130, the second bracket 140, the C-ring 150, and the bottom cover 160 in the embodiment of the present invention are not limited to any material or a single material. In one embodiment, the material can be recycled material; in another embodiment, the material can be stainless steel. The embodiment of the present invention is not limited by any material.

The closed state or unlocked state of the present invention is all performed according to the above-mentioned working principle, and as long as it conforms to the above-mentioned working principle to perform the closing or unlocking movement, it falls within the equivalent scope of the patent application scope of the present invention.

Figure 9:
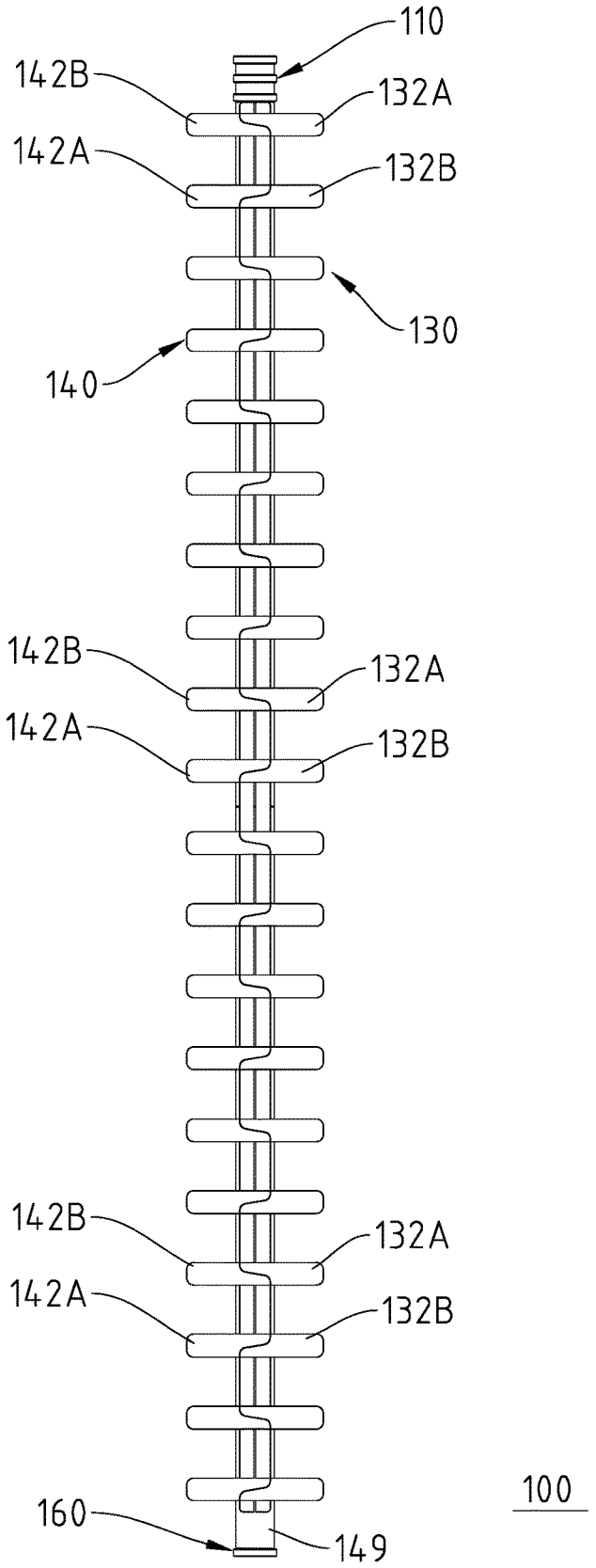
FIG. 9 is a front view of the multi-ring binder of the present invention in a closed state.
Figure 10:
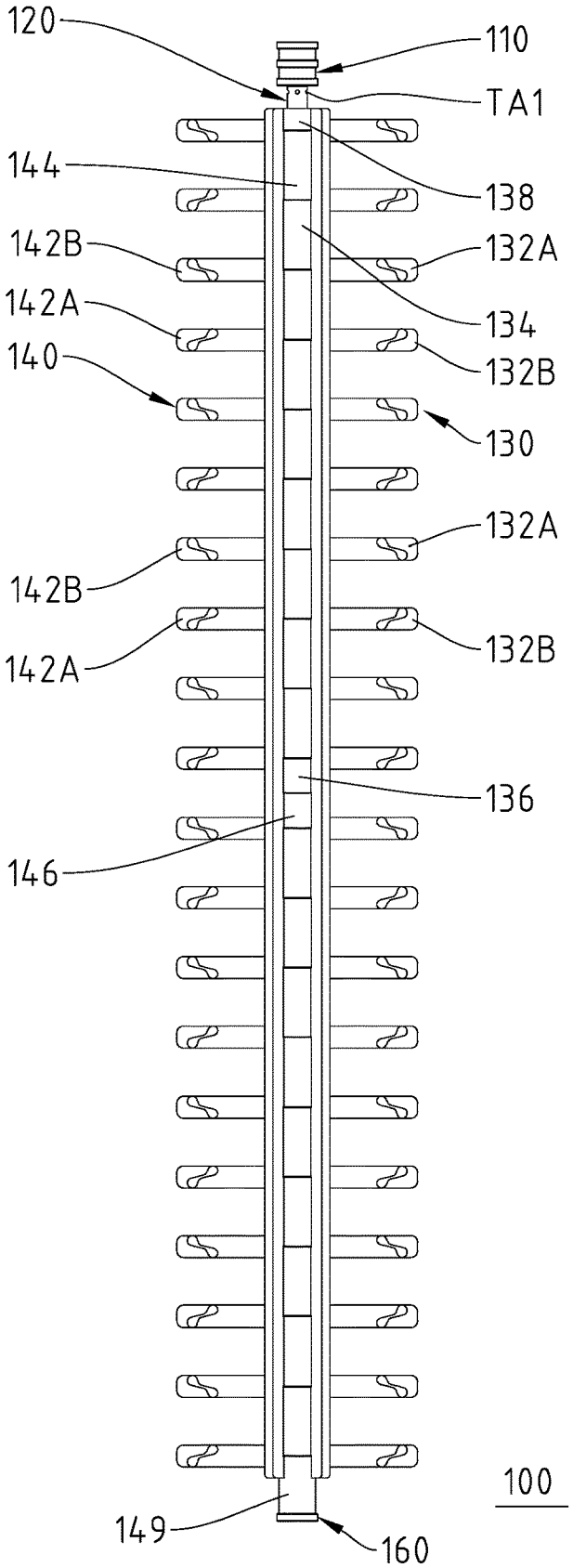
FIG. 10 is a front view of the multi-ring binder of the present invention in an open state.

Next, please refer to FIG. 9 and FIG. 10. FIG. 9 is a front view of the multi-ring binder of the present invention in a closed state. FIG. 10 is a front view of the multi-ring binder of the present invention in an open state. As shown in the drawings, in the multi-ring binder 100 disclosed in the present invention, the user can control the unlocking and locking states of the movable central spindle 120 by manually operating (pulling or pushing) the positioning lock pin 110, and then operate each ring opening and closing. It should be noted that the first half-rings 132A (or 142A) are semicircular and their tops are convex and concave; in addition, the second half-rings 132B (or 142B) are semicircular and their top is convex and concave (corresponding to and matching the convex and concave top of the first half-rings 132A (or 142A). As shown in FIG. 1 and FIG. 9, when the user closes the multi-ring binder and pushes the positioning lock pin 110, the movable central spindle 120 is in a locked state, the first half-rings 132A on the first bracket 130 and the second half-rings 142B on the second bracket 140 are correspondingly snapped to each other to form complete rings, and the second half-rings 132B on the first bracket 130 and the first half-rings 142A on the second bracket 140 are correspondingly snapped to each other to form complete rings. In addition, as shown in FIGS. 8 and 10, when the user pulls up the positioning lock pin 110, the movable central spindle 120 is in an unlocked state, at this time, the originally closed multiple first half-rings 132A (or 142A) and multiple second half-rings 132B (or 142B) can be freely opened or closed.

It should be further noted that, on one side of the first bracket 130, the positional layout of the half-rings thereof is a staggered pattern of the first half-ring 132A, the second half-ring 132B and the first half-ring 132A in sequence. On the other side of the second bracket 140, the positional layout of the half rings is a staggered pattern of the second half-ring 142B, the first half-ring 142A and the second half-ring 142B in sequence. Each complete ring is formed by the symmetrical snap-fit of the first half-ring 132A (or 142A) and the second half-ring 142B (or 132B), and each complete ring is that the upper convex portion of the first half-ring 132A (or 142A) is snap-fitted to the upper concave portion of the second half-ring 142B (or 132B), and the lower concave portion of the first half-ring 132A (or 142A) is snap-fitted to the lower convex portion of the second half-ring 142B (or 132B).

Figure 11:
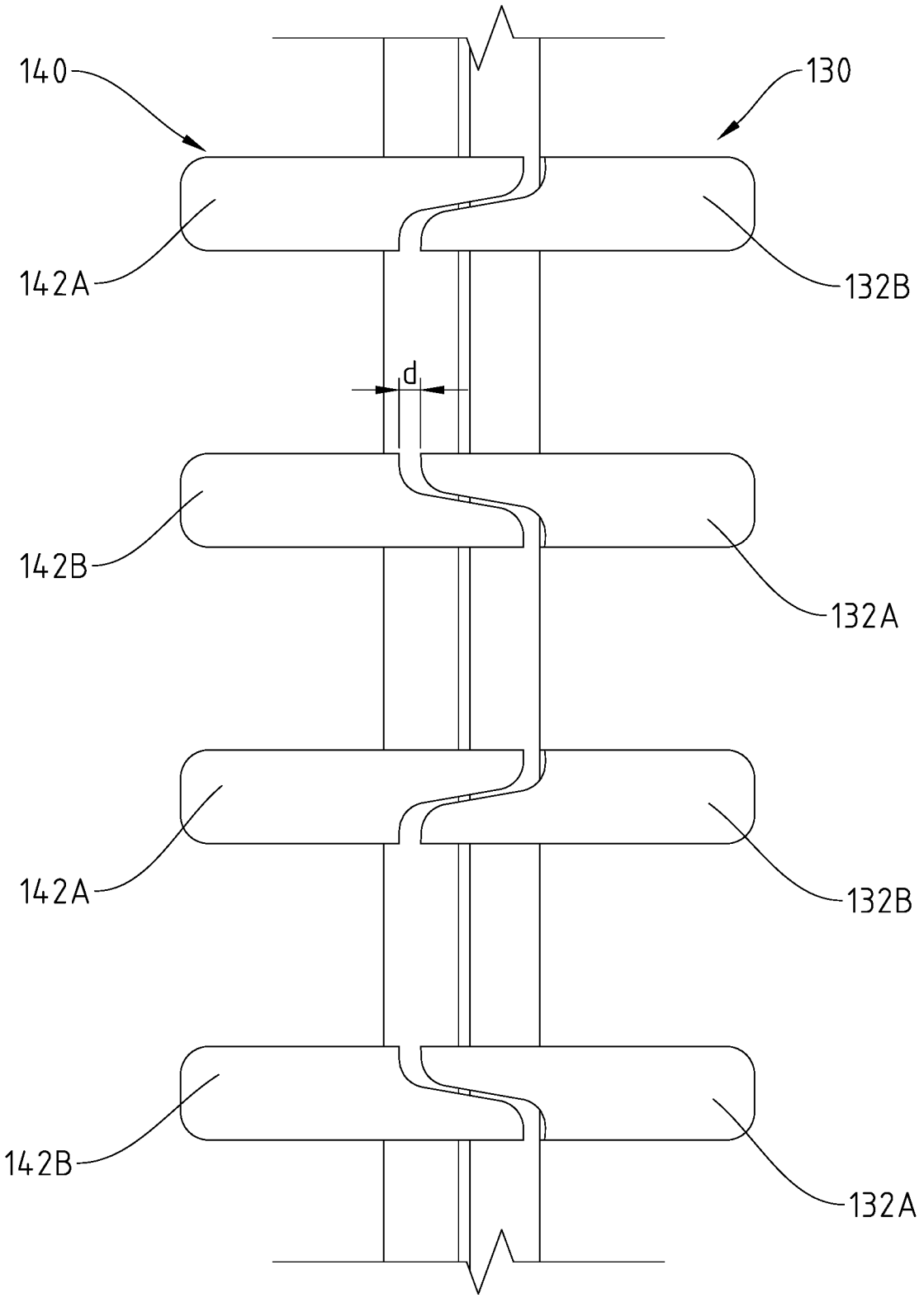
FIG. 11 is a partial schematic diagram of the multi-ring binder of the present invention.
Figure 12:
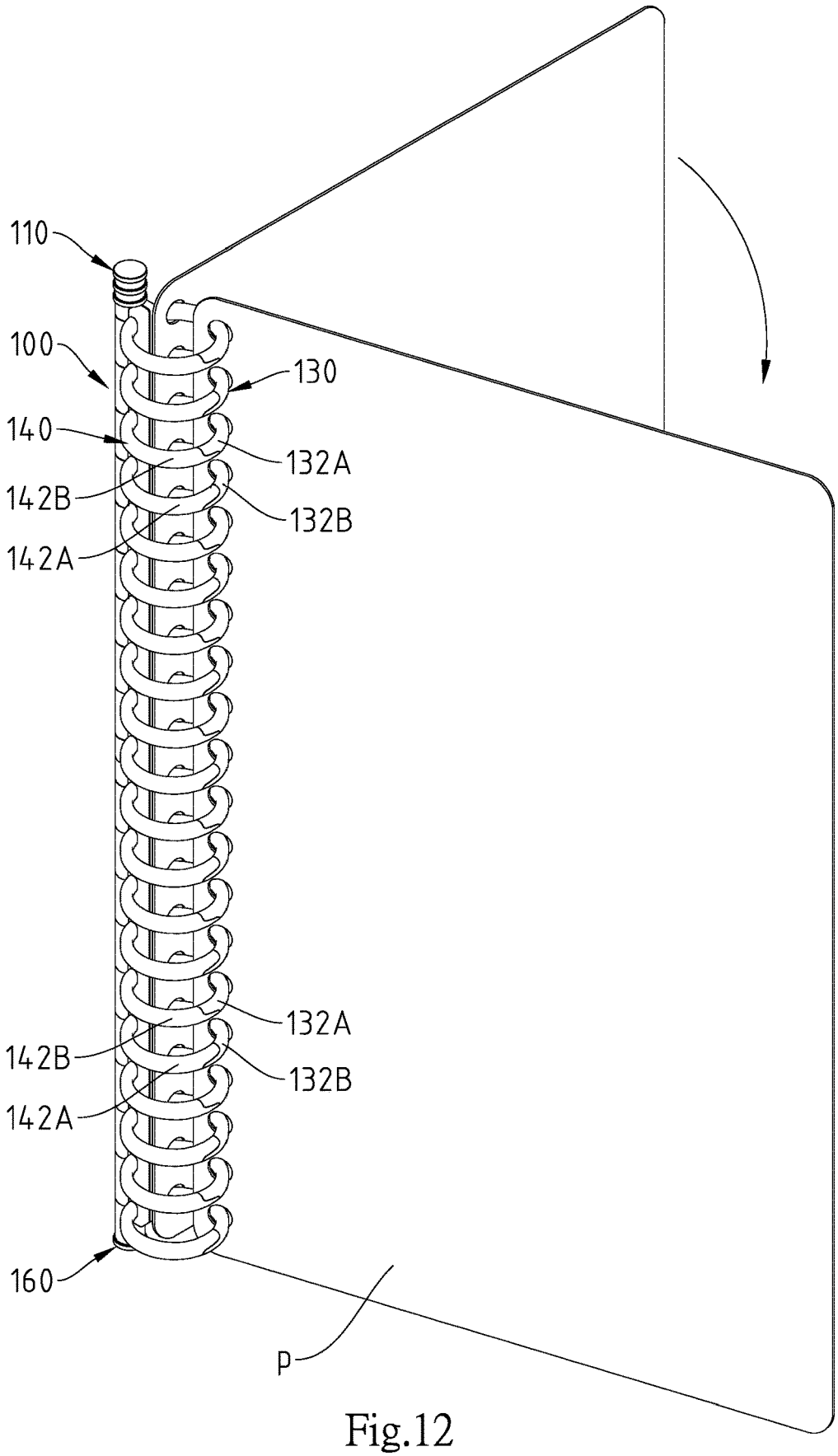
FIG. 12 is a schematic diagram of the loose-leaf application of the multi-ring binder of the present invention.
Figure 13:
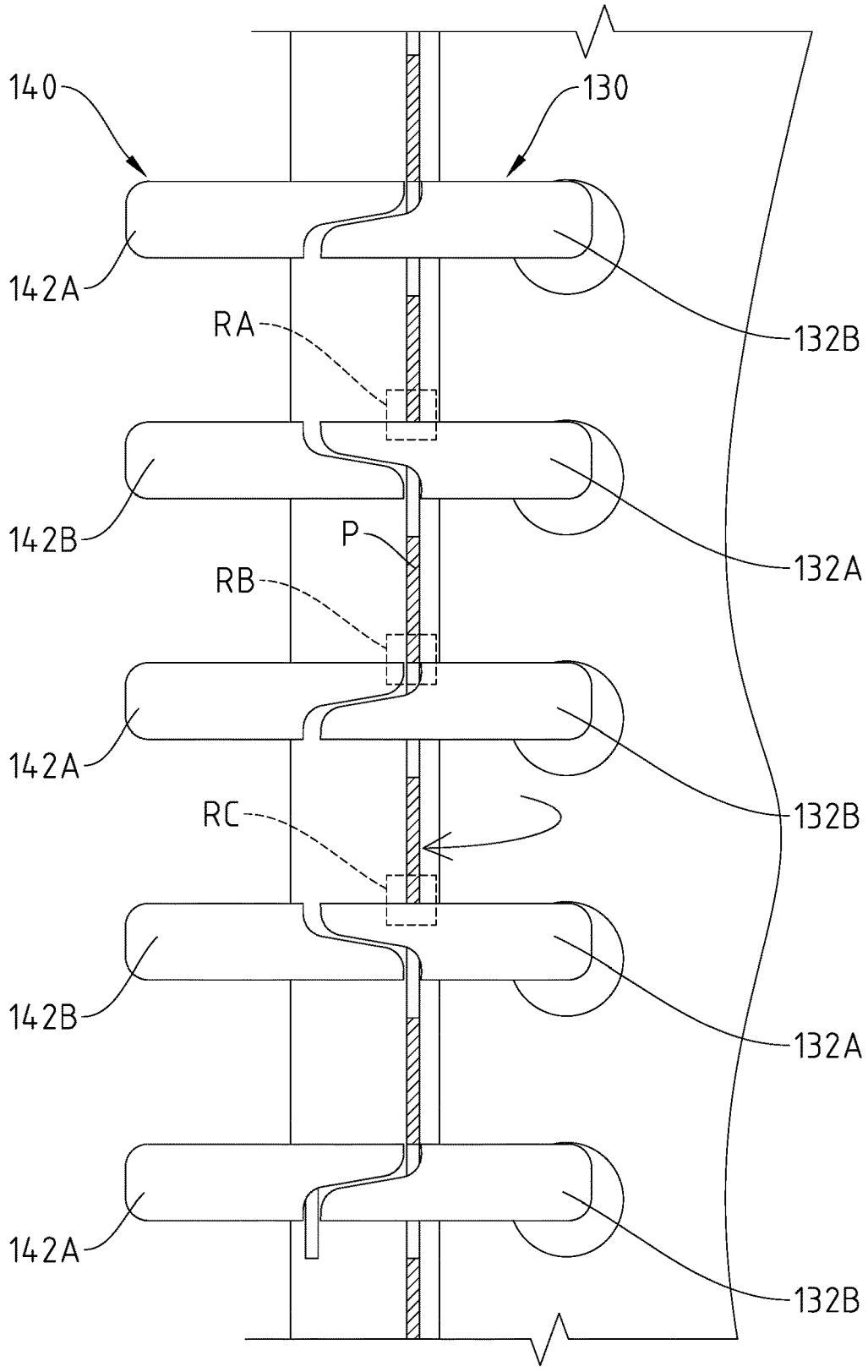
FIG. 13 is a partial schematic diagram of the first state of the page turning action of FIG. 12.
Figure 14:
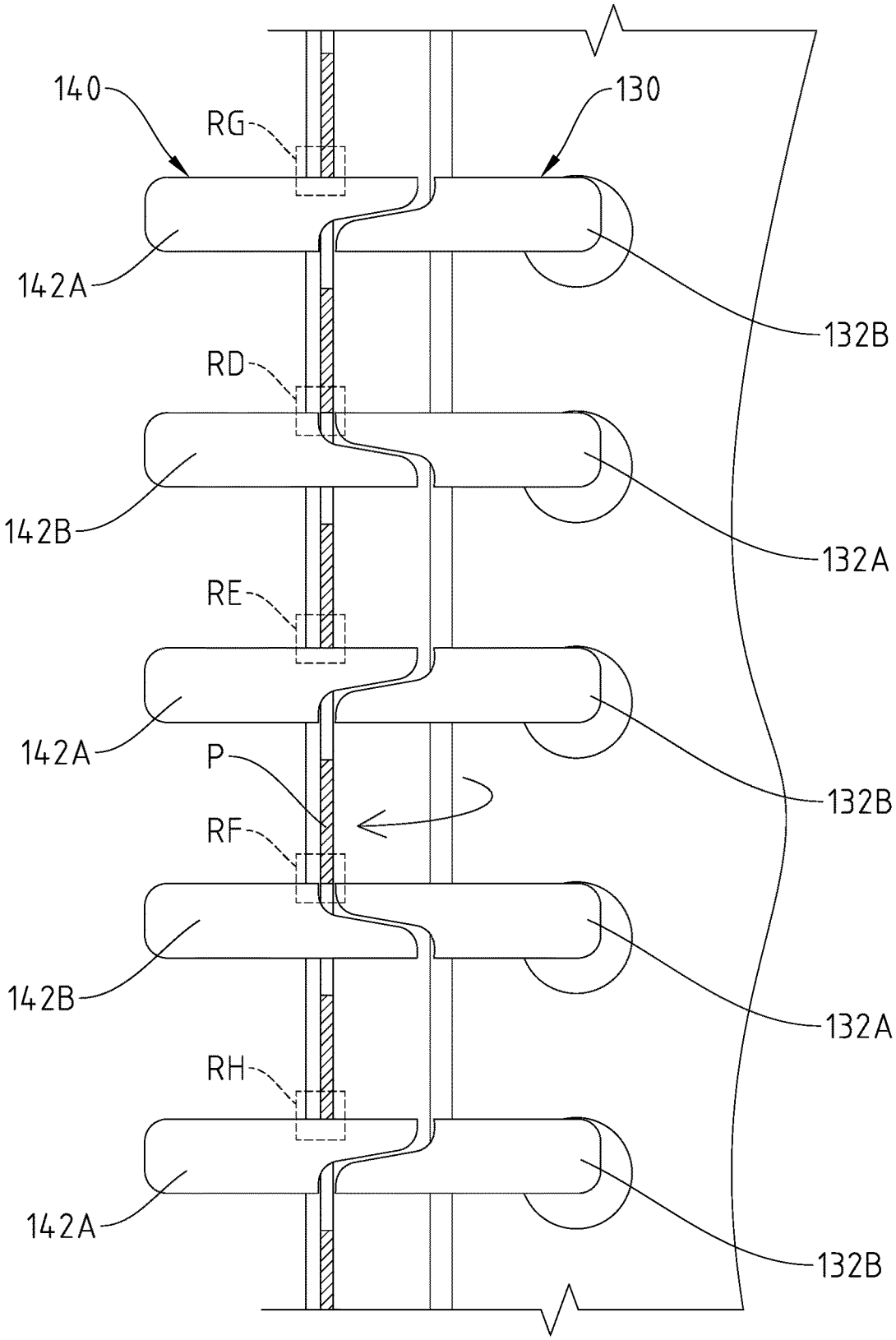
FIG. 14 is a partial schematic diagram of the second state of the page turning action of FIG. 12.

Please refer to FIGS. 11 to 14 at the same time. FIG. 11 is a partial schematic diagram of the multi-ring binder of the present invention. FIG. 12 is a schematic diagram of the loose-leaf application of the multi-ring binder of the present invention. FIG. 13 is a partial schematic diagram of the first state of the page turning action of FIG. 12. FIG. 14 is a partial schematic diagram of the second state of the page turning action of FIG. 12. As can be seen from FIG. 11, in the embodiment of the present invention, if the multi-ring binder 100 is used for a long time or other factors, at least one group of first half-ring 132A (or 142A) and second half-ring 142B (or 132B) cannot be fully snap-fitted (a complete ring cannot be formed) resulting in a gap distance d (when the multi-ring binder 100 is in a closed state), so in the prior art, the user is using a notebook with a traditional ring binder and when turning pages, loose-leaf paper jams are prone to occur.

Further, it can be seen from FIGS. 12 to 14 that in FIG. 13, when the user is turning the loose-leaf paper P, the loose-leaf paper P is likely to fall into the groove in the area RB due to the above reasons, and the opening distance of the groove is the gap distance d, however, since the multi-ring binder 100 is a staggered upper and lower half-ring layout, the loose-leaf paper P in other areas RA or RC will be jammed by the upper convex portion of the adjacent first half-ring 132A or restrict the possibility of the loose-leaf paper moving downward, so as to prevent the loose-leaf paper from jamming. After that, in FIG. 14, when the user continues to turn the above loose-leaf paper P, the loose-leaf paper P is likely to fall into the groove in the area RD or RF due to the above-mentioned reasons, and the opening distance of the groove is the gap distance d, however, since the multi-ring binder 100 is a staggered upper and lower half-ring layout, the loose-leaf paper P in other areas RE, RG and RH will be jammed by the upper convex portion of the adjacent first half-ring 132A or restrict the possibility of the loose-leaf paper moving downward, so as to prevent the loose-leaf paper from jamming. In short, the special half-ring layout of the embodiment of the present invention can prevent and avoid loose-leaf paper jams. The multi-ring binder in FIGS. 13 to 16 is related actions applied to notebooks with multiple loose-leaf pages.

To sum up, the multi-ring binder for a loose-leaf notebook with a plurality of loose-leaf pages disclosed in the present invention can bring the following effects:

1. High security and high stability.
2. Make it easy for users to operate the switch and replace the inner page.
3. The page turning is smooth, and it can effectively avoid the tearing and damage of the paper holes, which can prolong the service life of the notebook.
4. The notebook is easy to fold back, easy to hold with one hand, and highly flexible.
5. The structure is relatively simple, which can reduce the process and cost, and reduce the failure rate.

The above descriptions are only preferred embodiments of the present invention, and are not intended to limit the scope of implementation of the present invention. Therefore, all equivalent changes or modifications made according to the features and spirit described in the scope of the present invention shall include within the scope of the patent application of the present invention.

What the invention claimed is:

1. A multi-ring binder used in a loose-leaf notebook with multiple loose-leaf pages, comprising:

a positioning lock pin;

a movable central spindle comprising a main body formed by alternatively connecting a plurality of cylindrical bodies and a plurality of rectangular bodies in a line and a body top located on a top side of said main body and connected to said positioning lock pin, the said rectangular body adjacent to said body top comprising a first positioning groove and a second positioning groove, said movable central spindle being drivable to move by said positioning lock pin;

a first bracket comprising a plurality of first half-rings and a plurality of second half-rings staggered and arranged thereon at equal distances from each other and a plurality of first hollow bodies and a top hollow body arranged thereon at appropriate intervals, the shapes of said first hollow bodies and said top hollow body being both outer circle and inner square;

a second bracket, said second bracket and said first bracket being substantially complementary symmetrical, said second bracket comprising a plurality of first half-rings and a plurality of second half-rings staggered and arranged thereon equidistantly from each other and a plurality of second hollow bodies and a bottom hollow body arranged thereon at appropriate intervals, the shapes of said second hollow bodies and said bottom hollow body being both outer circle and inner square, the shapes and positions of said second half-rings corresponding to said first half-rings; and a C-ring connected to said first bracket;

wherein through the symmetrical engagement of said first bracket and said second bracket, said first hollow bodies and said second hollow bodies are joined to each other to form a continuous hollow body, and said movable central spindle is arranged in said continuous hollow body to serve as the common central axis of rotation of said first bracket and said second bracket, and the external shape of said continuous hollow body is an outer circle and an inner square.

2. The multi-ring binder as claimed in claim 1, wherein the length of said rectangular bodies is less than the length of said first hollow bodies or less than the length of said second hollow bodies.

3. The multi-ring binder as claimed in claim 1, wherein the external shape of said top hollow body of said first bracket is an outer circle and an inner square, and said top hollow body of said first bracket comprises a C-ring groove that accommodates said C-ring.

4. The multi-ring binder as claimed in claim 3, wherein said C-ring performs a positioning action by engaging in said first positioning groove or said second positioning groove.

5. The multi-ring binder as claimed in claim 4, wherein after said positioning lock pin is pulled up and drives said movable central spindle, said C-ring is engaged with said second positioning groove.

6. The multi-ring binder as claimed in claim 5, wherein when said C-ring is engaged with said second positioning groove, said rectangular bodies on said movable central spindle move to the inside of said first hollow bodies or said second hollow bodies respectively to enter the unlocked state, thereby allowing said first half-rings or said second half-rings rotary movement to open or close the rings.

7. The multi-ring binder as claimed in claim 4, wherein after said positioning lock pin is pushed back and drives said movable central spindle, said C-ring is engaged with said first positioning groove.

8. The multi-ring binder as claimed in claim 7, wherein when said C-ring is engaged with said first positioning groove, a part of said rectangular bodies on said movable central spindle is moved to the inside of said first hollow bodies and the other part of said rectangular bodies is moved to the inside of said second hollow bodies to enter a locked state, in turn, said first half-rings and said second half-rings are prohibited from rotation to open or close the rings.

9. The multi-ring binder as claimed in claim 1, wherein when said positioning lock pin is pulled up and drives said movable central spindle into the unlocked state, the user manually rotates said first bracket or said second bracket around said movable central spindle to open or close the rings.

10. The multi-ring binder as claimed in claim 1, wherein said movable central spindle has one end thereof provided with a limit portion and an opposite end thereof connected to said positioning lock pin, and the opening and closing states of said movable central spindle are controlled through said positioning lock pin.

11. The multi-ring binder as claimed in claim 1, wherein said first half-rings are semi-circular, each having a convex top and a concave bottom.

12. The multi-ring binder as claimed in claim 1, wherein said second half-rings are semi-circular, each having a convex bottom and a concave top.

13. The multi-ring binder as claimed in claim 1, wherein when said movable central spindle is in the closed state, said first half-rings on said first bracket and said second half-rings on said second bracket are respectively snapped with each other to form a respective ring, and said second half-rings on said first bracket and said first half-rings on said second bracket are respectively snapped with each other to form a respective ring.

14. The multi-ring binder as claimed in claim 1, wherein the positional layout of the half-rings of said first bracket is a staggered pattern of the first half-ring, the second half-ring and the first half-ring in sequence.

15. The multi-ring binder as claimed in claim 1, wherein the positional layout of the half-rings of said second bracket is a staggered pattern of the second half-ring, the first half-ring and the second half-ring in sequence.

* * * * *